US006844530B2

(12) United States Patent
Bennett et al.

(10) Patent No.: US 6,844,530 B2
(45) Date of Patent: Jan. 18, 2005

(54) THAW-SERVER SYSTEM FOR CONVECTION COOKING APPLIANCE

(75) Inventors: Perry A. Bennett, Cleveland, TN (US); Mark A. Boyer, Harrison, TN (US); Jackie M. Caruso, Ooltewah, TN (US); Robert R. Ferris, Cleveland, TN (US); Valerie L. Hern-Fonseth, Hixson, TN (US); Brian C. Jones, Ooltewah, TN (US); Jeffrey K. McLeod, Riceville, TN (US); James D. Nichols, Cleveland, TN (US); Marilyn L. Sterchi, Harrison, TN (US)

(73) Assignee: Maytag Corporation, Newton, IA (US)

( * ) Notice: Subject to any disclaimer, the term of this patent is extended or adjusted under 35 U.S.C. 154(b) by 108 days.

(21) Appl. No.: 10/410,137

(22) Filed: Apr. 10, 2003

(65) Prior Publication Data

US 2004/0200827 A1 Oct. 14, 2004

(51) Int. Cl.[7] ..... H05B 1/02; F27D 11/00

(52) U.S. Cl. ..... 219/491; 219/494; 219/400

(58) Field of Search ..... 219/400, 401, 219/402, 491, 492, 494, 405, 411, 701, 754; 126/21 A; 34/225; 426/243, 524; 99/447, 451, 352

(56) References Cited

U.S. PATENT DOCUMENTS

| | | | | |
|---|---|---|---|---|
| 2,906,620 A | | 9/1959 | Jung | |
| 3,261,650 A | * | 7/1966 | Borje | 219/400 |
| 3,368,062 A | | 2/1968 | Gramenius et al. | |
| 3,465,124 A | | 9/1969 | Sauer | |
| 3,501,620 A | | 3/1970 | Sauer | |
| 3,538,904 A | | 11/1970 | Baker | |
| 3,548,153 A | | 12/1970 | Kells | |
| 3,682,643 A | * | 8/1972 | Foster | 219/405 |
| 3,828,760 A | | 8/1974 | Farber et al. | |
| 3,857,988 A | | 12/1974 | Jensen et al. | |
| 3,920,859 A | * | 11/1975 | Foster | 426/524 |
| 4,109,636 A | | 8/1978 | Burge | |
| 4,262,183 A | | 4/1981 | Smith et al. | |
| 4,409,453 A | * | 10/1983 | Smith | 219/400 |
| 4,624,301 A | | 11/1986 | Baggott et al. | |
| 4,812,622 A | | 3/1989 | Takeda et al. | |
| 4,874,914 A | | 10/1989 | Eke | |
| 5,285,719 A | * | 2/1994 | McFadden et al. | 99/483 |
| 5,326,578 A | | 7/1994 | Yun | |
| 5,747,775 A | * | 5/1998 | Tsukamoto et al. | 219/400 |
| 5,801,362 A | | 9/1998 | Pearlman et al. | |
| 5,882,191 A | | 3/1999 | Kristensen | |
| 2002/0134778 A1 | | 9/2002 | Day et al. | |

* cited by examiner

*Primary Examiner*—Tu Ba Hoang
(74) *Attorney, Agent, or Firm*—Diederiks & Whitelaw, PLC

(57) ABSTRACT

A cooking appliance incorporates a convection system including a blower or fan having an associated heating element used for thawing food items in an oven cavity. The convection fan and its associated heating element are specifically controlled to regulate the air flow and temperature within the oven cavity in a manner which significantly reduces thaw time over ambient conditions, while not negatively effecting food quality. In accordance with the most preferred form of the invention, the convection fan is constantly operated at a high RPM and the convection heating element is operated in the order of 80° F.–100° F. (approximately 26–38° C.) in order to establish and maintain an oven cavity temperature of about 80° F. (approximately 26° C.) for food thawing purposes.

16 Claims, 2 Drawing Sheets

SELECT OPTION
THAW
UPPER OVEN
TIMER1 On/Off
TIMER2 On/Off
Help
Favorites
Setup
Back
Space
Enter
UPPER OVEN
CANCEL
Convect Bake
Clean
Broil
More Options
Oven Light
LOWER OVEN
BAKE ELEMENT
BROIL ELEMENT
FAN
CONVECT HEATING ELEMENT
CPU
TEMP SENSORS
FAN SPEED SENSOR

THAW-SERVER SYSTEM FOR CONVECTION COOKING APPLIANCE

BACKGROUND OF THE INVENTION

1. Field of the Invention

The present invention pertains to the art of cooking appliances and, more particularly, to a system for thawing food in an oven cavity of a convection cooking appliance.

2. Discussion of the Prior Art

The art of cooking is currently undergoing substantial change. It is no longer the norm to have a family member home all day with time to cook and prepare meals. Today, more and more consumers must rush home from work to prepare meals for themselves or for their families. In today's fast paced society, time is of the essence. The luxury of spending time in preparing a meal is becoming less and less affordable.

As such, consumers demand an oven that will prepare a meal in less time than conventional ovens, without sacrificing the quality of the prepared food. In order to meet these demands, manufacturers are combining conventional radiant cooking systems with the rapid cook advantages of convection, microwave and other types of cooking systems. In particular, it is considered that incorporating a forced air convection system capable of performing both convection and standard radiant cooking can enable a business or individual to cook an appetizing meal in a short time period.

Certainly, rapid cooking systems enhance the ability of an individual to prepare a meal in a relatively short period of time. However, time doesn't always permit adequate planning of meals. For this and other reasons, the range of permissible meals is limited. For instance, an individual would typically have to plan ahead if a meal was going to include the use of frozen food items which would need to be thawed prior to serving. Although rapid or other types of cooking appliances can be employed to thaw food, the detriment to food quality has, to date, resulted in food items being preferentially thawed under ambient conditions, such as on a kitchen countertop. Again, the time needed to thaw frozen foods under ambient conditions can limit one's ability to serve a desired meal.

Although there exist cooking appliances which can perform thaw operations, there still exists a need in the art of cooking for an appliance which, in addition to reducing necessary cooking times in general, is configured for rapidly and efficiently thawing food items.

SUMMARY OF THE INVENTION

The present invention is directed to a cooking appliance including, in addition to one or more radiant heating elements in an oven cavity, a convection system which produces a convection heat flow in the oven cavity. The convection system includes a blower or fan having an associated heating element. The present invention is concerned with utilizing the convection system for thawing frozen food items in the oven cavity and, particularly, thawing frozen baked items, such as bread, pastry, pics and the like.

In accordance with the invention, the convection fan and its associated heating element are specifically controlled to regulate the air flow and temperature within the oven cavity in a manner which significantly reduces thaw time over ambient conditions, while not negatively effecting food quality. In accordance with the most preferred form of the invention, the convection fan is operated at a high rotations-per-minute (RPM) and the convection heating element is operated in the order of 80° F.–100° F. (approximately 26–38° C.) in order to establish and maintain an oven cavity temperature of about 80° F. (approximately 26° C.).

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
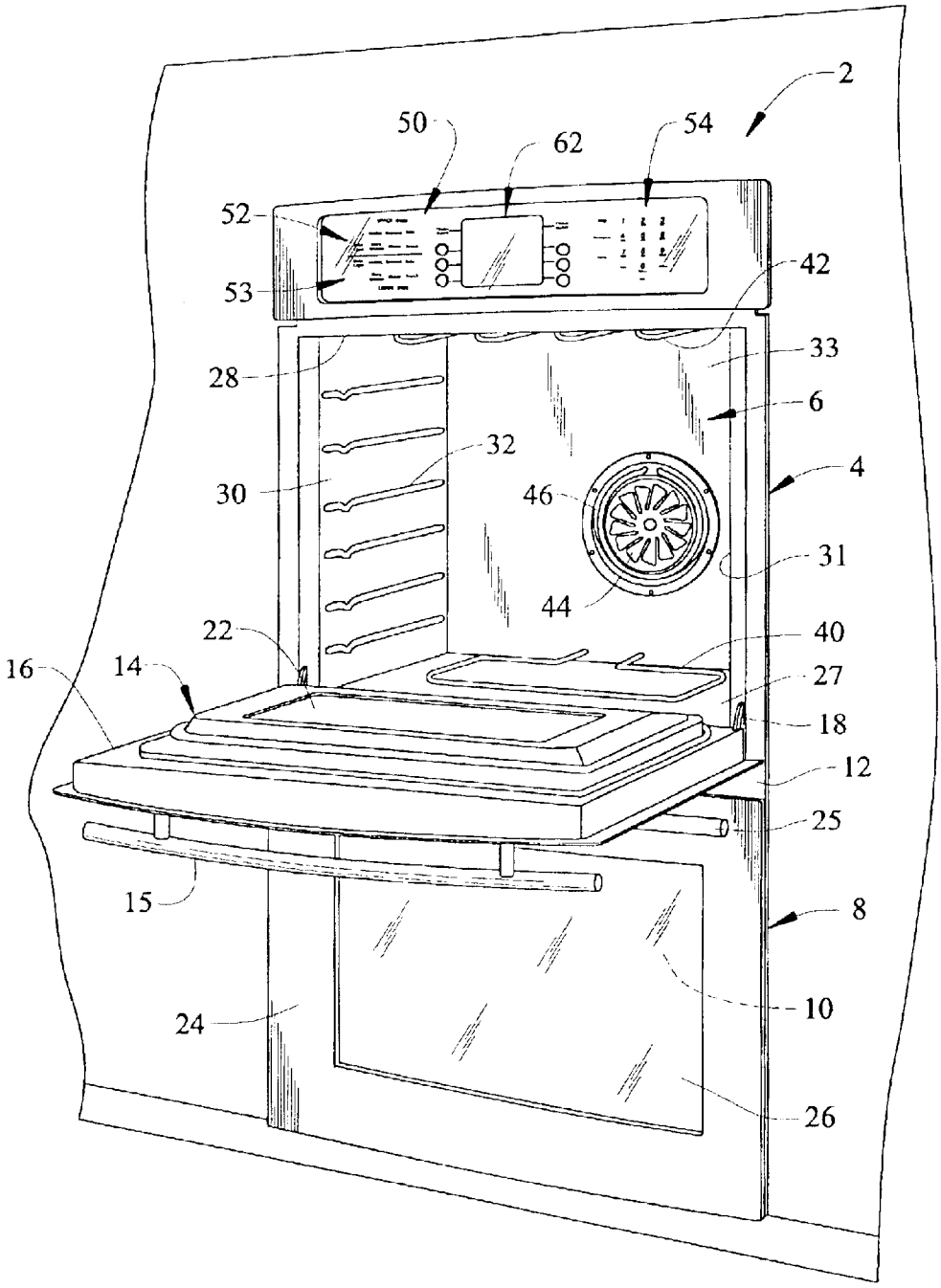
FIG. 1 is a perspective view of a wall oven constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention is not limited to this model type and can be incorporated into various types of oven configurations, e.g., cabinet mounted ovens, as well as both slide-in and free standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 includes an outer frame 12 for supporting both upper and lower oven cavities 6 and 10.

In a manner known in the art, a door assembly 14 is provided to selectively provide access to upper oven cavity 6. As shown, door assembly 14 includes a handle 15 at an upper portion 16 thereof. Door assembly 14 is adapted to pivot at a lower portion 18 to enable selective access to within oven cavity 6. In a manner also known in the art, door 14 is provided with a transparent zone or window 22 for viewing the contents of oven cavity 6 while door 14 is closed. A corresponding door assembly 24 including a handle 25 and a transparent zone or window 26 is provided to selectively access lower oven cavity 10.

As best seen in FIG. 1, oven cavity 6 is defined by a bottom wall 27, an upper wall 28, opposing side walls 30 and 31 provided with a plurality of vertically spaced side rails 32, and a rear wall 33. In the preferred embodiment shown, bottom wall 27 is constituted by a flat, smooth surface designed to improve the cleanability of oven cavity 6. Arranged adjacent bottom wall 27 of oven cavity 6 is a bake element 40. Also, a top broiler element 42 is arranged along upper wall 28 of oven cavity 6. Top broiler element 42 is provided to enable a consumer to perform a grilling process in upper oven 4 and to aid in pyrolytic heating during a self-clean operation. In the preferred form of the invention shown, both bake element 40 and top broiler element 42 are constituted by sheathed electric resistive heating elements.

Based on the above, in the preferred embodiment depicted, cooking appliance 2 actually constitutes an electric, dual wall oven. However, it is to be understood that cooking appliance 2 could equally operate on gas, either natural or propane. In any case, both oven cavities 6 and 10 preferably employ both radiant and convection heating techniques for cooking food items therein. To this end, rear wall 33 is shown to include a convection fan or blower 44 which can operate at varying speeds, i.e., at least low, medium and high speeds. Although the exact position and construction of fan 44 can readily vary in accordance with the invention, in accordance with the most preferred form of the invention, fan 44 draws in air at a central intake zone (not separately labeled) and directs the air into oven cavity 6 in a radial outward direction. Also as clearly shown in this figure, another sheathed electric heating element 46, which preferably takes the general form of a ring, extends circumferentially about fan 44 in order to heat the radially expelled air flow. At this point, it should be noted that a fan cover, which has not been shown for the sake of clarity of the drawings, extends about fan 44 and heating element 46, preferably with the cover having an associated central inlet opening and a plurality of outer radial outlets openings.

Figure 2:
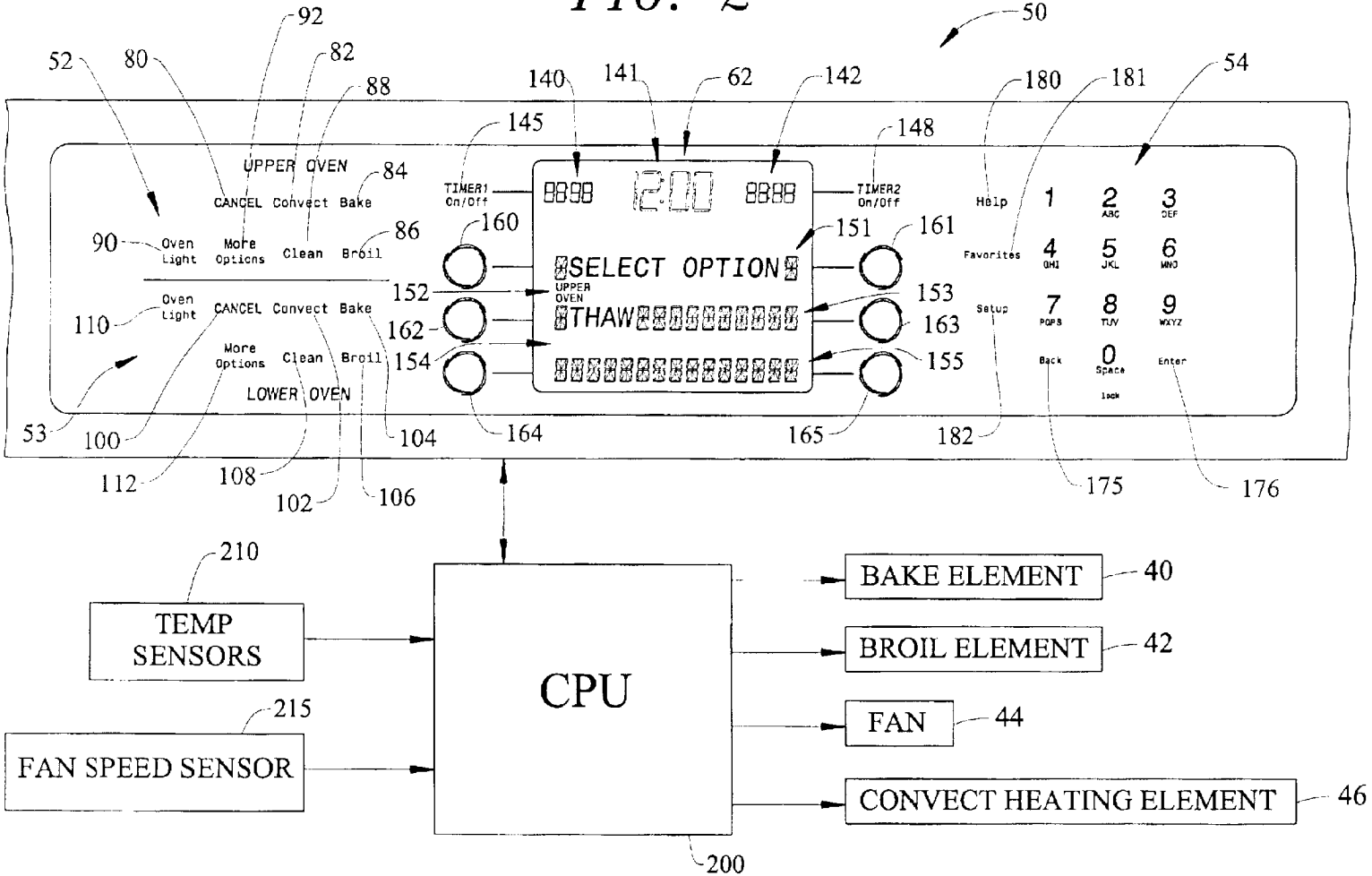
FIG. 2 is an enlarged view of a control panel employed in connection with the wall oven of FIG. 1.

As further shown in FIGS. 1 and 2, cooking appliance 2 includes an upper control panel 50 having a plurality of control elements. In accordance with one embodiment, the control elements are constituted by first and second sets of oven control buttons 52 and 53, as well as a numeric pad 54. Control panel 50 is adapted to be used to input desired cooking parameters for cooking appliance 2. More specifically, the first and second sets of control buttons 52 and 53, in combination with numeric pad 54 and a display 62, enable a user to establish particular cooking operations for upper and lower ovens 4 and 8 respectively.

In the preferred embodiment particularly shown in FIG. 2, first set of control buttons 52 includes a cancel button 80, a convection button 82, a bake button 84, a broil button 86, and a clean button 88. In addition, first set of control buttons 52 also preferably includes an oven light button 90 and a button 92 used to access more cooking options which are conveyed to the user through display 62. In a corresponding manner, second set of control buttons 52 includes a cancel button 100, a convection button 102, a bake button 104, a broil button 106, and a clean button 108. Further more, second set of control buttons 53 also preferably includes an oven light button 110 and a button 112 which is used to access more cooking options that are conveyed to the user through display 62.

To this end, display 62 is preferably divided into various sections. In accordance with the most preferred embodiment of the invention, an uppermost section of display 62 is sub-divided into three time display zones 140–142. More specifically, leftmost display zone 140 constitutes a first timer zone having an associated timer button 145. Central display zone 141 constitutes a clock for cooking appliance 2. Rightmost display zone 142 constitutes a second timer zone having an associated timer button 148.

Spaced below time display zones 140–142 are a series of vertically is spaced information display zones 151–155. Each of information display zones 151, 153 and 155 has associated left and right portions (not separately labeled). Each of the left and right portions have associated therewith laterally positioned selection buttons 160–165.

As shown, numeric pad 54 preferably enables alphanumeric input. That is, in addition to presenting numbers 0–9, numeric pad 54 doubles as an input source for alpha information. To this end, the number 2 button functions for ABC letter entry; the number 3 button functions for DEF letter entry; the number 4 button functions for GHI letter entry; the number 5 button functions for JKL letter entry; the number 6 button functions for MNO letter entry; the number 7 button functions for PQRS letter entry; the number 8 button functions for TUV letter entry; and the number 9 button functions for WXYZ letter entry. The number 0 button can also be used to input a space. On either side of the number 0 button are Back and Enter buttons 175 and 176 which can be pressed simultaneously to lock numeric pad 54 or used in combination with the various alpha keys for information entry as will be discussed more fully below. Finally, provided adjacent numeric pad 54 are Help, Favorites and Setup buttons 180–182.

In general, control panel 50 is linked to a controller or CPU 200 formed as part of cooking appliance 2. Therefore, CPU 200 receives user inputs and selections through control panel 50, as well as signals from sensors associated with cooking appliance 2, i.e. oven temperature sensors for upper and lower ovens 4 and 8 as generally indicated at 210 and a fan speed sensor 215. In turn, CPU 200 controls bake element 40, top broiler element 42, convection fan 44, and convection heating element 46.

The general programming and operation of cooking appliance 2 does not form part of the present invention such that these features will not be discussed in detail here. Actually, the manner in which cooking appliance 2 is programmed is disclosed in co-assigned U.S. Patent Application entitled "Menu Driven Control Interface For a Cooking Appliance" filed on even date herewith and incorporated herein by reference. Instead, the present invention is particularly directed to utilizing cooking appliance 2 in thawing food items. In accordance with the invention, upon depressing More Options button 112, display 62 presents a thaw option which can be selected, such as by pushing select button 162. If the thaw option is selected, convection fan 44 and its associated heating element 46 are specifically controlled to regulate the air flow and temperature within oven cavity 6. In connection with the thaw feature of the present invention, convection fan 44 is continuously operated at a high speed or RPM setting, which is also employed in connection with a roasting operation, and the convection heating element 46 is operated in the order of 80° F.–100° F. (approximately 26–38° C.) in order to establish and maintain a desired oven cavity temperature, preferably approximately 80° F. (approximately 26° C.).

With this method of heating oven cavity 6, it has been found that cooking appliance 2 can be utilized to thaw frozen food items in a rapid manner, while not negatively effecting food quality. This method has actually been found to be extremely effective when used in connection with frozen baked items, such as bread/pastry, pies and the like. For instance, it has been found that employing this method will not toughen frozen bread, melt icing on pastry, or cook filling in a pie. In any case, although described with reference to a preferred embodiment of the invention, it should be readily understood that various changes and/or modifications can be made to the invention without departing from the spirit thereof. For instance, although the invention has been described with reference to thawing in oven cavity 6, it should be understood that a similar function can be employed for oven cavity 10. In addition, although bake and broil heating elements 40 and 42 are preferably not utilized during food thawing in accordance with the preferred embodiment, it is possible that these heating elements could be utilized to a limited degree, such as in connection with rapidly preheating oven cavity 6 to the desired thaw temperature. In general, the invention is only intended to be limited by the scope of the following claims.

We claim:

1. A cooking appliance comprising:

an oven cavity;

a fan for developing a convection air flow within the oven cavity;

at least one heating element for heating the air flow;

a control panel for selecting desired cooking operations for the oven cavity, with the desired cooking operations including a thaw operation; and means for controlling both said fan and said at least one heating element, said controlling means operating the fan on high speed and the at least one heating element in the order of 80° F.–100° F. (approximately 26–38° C.) when the thaw operation is selected.

2. The cooking appliance according to claim 1, wherein the controlling means continually operates the fan and the at least one heating element to maintain a substantially constant temperature in the oven cavity throughout the thaw operation.

3. The cooking appliance according to claim 2, wherein the controlling means maintains the temperature in the oven cavity at about 80° F. (approximately 26° C.) throughout the thaw operation.

4. The cooking appliance according to claim 3, wherein the at least one heating element constitutes a convection heating element.

5. The cooking appliance according to claim 4, wherein the convection heating element extends about the fan.

6. The cooking appliance according to claim 5, wherein the oven cavity includes a rear wall, both of the fan and the convection heating element being mounted at the rear wall.

7. The cooking appliance according to claim 1, wherein the at least one heating element constitutes a convection heating element.

8. The cooking appliance according to claim 7, wherein the convection heating element extends about the fan.

9. The cooking appliance according to claim 8, wherein the oven cavity includes a rear wall, both of the fan and the convection heating element being mounted at the rear wall.

10. The cooking appliance according to claim 1, wherein the control panel includes a display for presenting a thaw operation option and a selector member for selecting the thaw operation.

11. In a cooking appliance including an oven cavity, a fan for developing a convection air flow within the oven cavity, at least one heating element for heating the air flow, a method of thawing frozen food items in the oven cavity comprising:

activating the fan at a high RPM; and operating the at least one heating element in the order of 80° F.–100° F. (approximately 26–38° C.) to establish a desired operating temperature in the oven cavity.

12. The method of claim 11, wherein the fan is continually operated and the at least one heating element is activated to maintain a substantially constant temperature in the oven cavity throughout the thaw operation.

13. The method of claim 11, wherein the operating temperature in the oven cavity is maintained at about 80° F. (approximately 26° C.) throughout the thaw operation.

14. The method of claim 11, wherein the fan develops a flow of air which is directed over the at least one heating element which extends about the fan.

15. The method of claim 11, wherein the thaw operation is performed on frozen baked food items.

16. The method of claim 11, further comprising:

displaying a thaw operation option on a display of the cooking appliance; and initiating the thaw operation after the thaw operation option is selected.

* * * * *